US007140331B1

(12) United States Patent
Heinzen

(10) Patent No.: US 7,140,331 B1
(45) Date of Patent: Nov. 28, 2006

(54) BEAM SYSTEM MEMBRANE SUSPENSION FOR A MOTOR MOUNT

(75) Inventor: William J. Heinzen, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/353,462

(22) Filed: Feb. 14, 2006

(51) Int. Cl.
*F02B 71/00* (2006.01)
*B25C 1/14* (2006.01)

(52) U.S. Cl. ..... 123/46 SC; 227/10

(58) Field of Classification Search ..... 123/46 SC, 123/46 R; 227/10, 130
See application file for complete search history.

(56) References Cited

U.S. PATENT DOCUMENTS 6,520,397 B1 2/2003 Moeller

2004/0050901 A1* 3/2004 Turk ..... 227/130

FOREIGN PATENT DOCUMENTS

DE 20 2005 011 723 11/2005

* cited by examiner

*Primary Examiner*—Noah P. Kamen
(74) *Attorney, Agent, or Firm*—Lisa M. Soltis; Mark W. Croll; Greer, Burns & Crain, Ltd.

(57) ABSTRACT

A suspension system for a motor of a combustion-powered hand tool includes a motor retaining ring defining a space for accepting the motor, an outer ring radially spaced from the retaining ring and configured for attachment to a cylinder head of a combustion chamber, and at least one resilient suspension element configured for dampening vibrations between a motor support and a tool frame, and having a plurality of resilient beams connecting the retaining ring and the outer ring.

18 Claims, 3 Drawing Sheets

BEAM SYSTEM MEMBRANE SUSPENSION FOR A MOTOR MOUNT

BACKGROUND OF THE INVENTION

The present invention relates generally to improvements in portable combustion-powered fastener driving tools, and specifically to improvements relating to the suspension of a motor for a combustion chamber fan for decreasing the operationally induced acceleration forces experienced by the motor, and for decreasing wear and tear on the motor.

Portable combustion-powered tools for use in driving fasteners into workpieces are described in commonly assigned patents to Nikolich U.S. Pat. Re. No. 32,452, U.S. Pat. Nos. 4,522,162; 4,483,474; 4,403,722; 5,197,646; 5,263,439 and U.S. Pat. No. 6,520,397, all of which are incorporated herein by reference. Similar combustion-powered nail and staple driving tools are available commercially from ITW-Paslode of Vernon Hills, Ill.

Such tools incorporate a generally pistol-shaped tool housing enclosing a small internal combustion engine that is powered by a fuel cell. A battery-powered electronic power distribution unit produces a spark for ignition, and a fan located in the combustion chamber provides for an efficient combustion within the chamber and facilitates scavenging, including the exhaust of combustion by-products. The engine includes a reciprocating piston with an elongated, rigid driver blade disposed within a cylindrical body.

A valve sleeve is axially reciprocable about the cylinder and, through a linkage, moves to close the combustion chamber when a workpiece contact element at the end of the linkage is pressed against a workpiece. This pressing action also triggers a fuel-metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the workpiece. The piston then returns to its original, "ready" position, through differential gas pressures within the cylinder. Fasteners are fed into the nosepiece through a magazine, where they are held in a properly positioned orientation for receiving the impact of the driver blade.

Upon ignition of the combustible fuel/air mixture, the combustion in the chamber causes the acceleration of the piston/driver blade assembly and the penetration of the fastener into the workpiece if the fastener is present. This combined downward movement causes a reactive force or recoil of the tool body. Therefore, the fan motor, which is suspended in the tool body, is subjected to an acceleration opposite the power stroke of the piston/driver blade and fastener.

Almost immediately thereafter, a bumper at the opposite end of the cylinder stops the momentum of the piston/driver blade assembly, and the tool body is accelerated toward the workpiece. The motor and shaft are thus subjected to an acceleration force which is opposite the direction of the first acceleration. After experiencing these reciprocal accelerations, the motor oscillates with respect to the tool.

Conventional combustion powered tools require specially designed motors to withstand these reciprocal accelerations of the shaft and motor, and the resulting motor oscillations. The motors are equipped with custom modifications which result in expensive motors that increase the production cost of the tools.

Although prior suspension systems exist that are designed to stabilize the motors and prevent them from experiencing excessive acceleration forces, they are prior art systems with a larger mass or a higher level of rigidity, increasing the final manufacturing costs of the combustion-powered tools to which they pertain.

Therefore, there is a need for a motor suspension system for a combustion-powered tool with an increased resiliency that reduces operationally induced acceleration forces experienced by the tool during operation. There is also a need for a motor suspension system that accommodates the use of a more standard, cost-effective motor.

BRIEF SUMMARY OF THE INVENTION

The above-listed objects are met or exceeded by the present suspension system for a motor of a combustion-powered tool having a cylinder head and a combustion chamber. The present suspension system provides an increased resistance to combustion-induced oscillations, and reduces the acceleration forces experienced by the motor during operation of the tool. Due to the reduction in acceleration forces, a less expensive and more standard motor can be used in the tool.

More specifically, the present suspension system includes a motor retaining ring defining a space for accepting the motor, an outer ring radially spaced from the retaining ring and configured for attachment to the cylinder head of the combustion chamber, and at least one resilient suspension element configured for dampening vibrations between a motor support and a tool frame. The resilient suspension element includes a plurality of resilient beams connecting the retaining ring and the outer ring.

In another embodiment, a suspension system for a motor of a combustion-powered hand tool having a cylinder head includes a flexible web disposed between the motor and the cylinder head. The flexible web includes at least one dampening structure configured for reducing a plurality of acceleration forces that result from operation of the tool. The flexible web further includes a plurality of generally linearly extending beams configured for defining a plurality of triangular recesses radially located on the web. The beams are configured to form a border between each of the plurality of triangular recesses.

DETAILED DESCRIPTION OF THE PREFERRED EMBODIMENT

Figure 1:
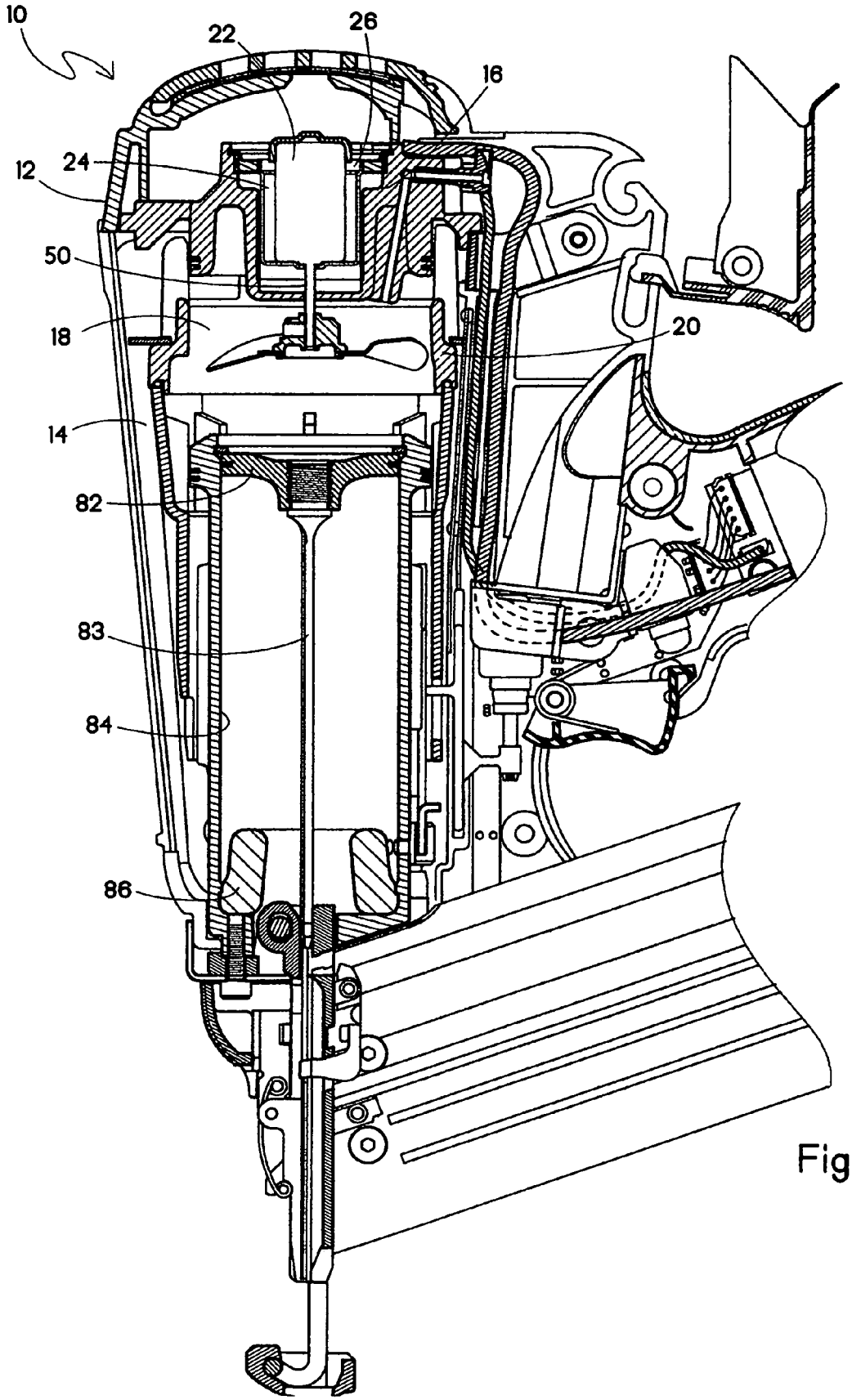
FIG. 1 is a fragmentary vertical section of a combustion-powered tool incorporating the present suspension system.

Referring now to FIG. 1, a combustion-powered tool of the type suitable for use with the present invention is generally designated 10. The tool 10 has a housing 12 including a main power source chamber 14. A cylinder head 16, disposed at an upper end 18 of the main chamber 14, defines an upper end of a combustion chamber 20, and provides a spark plug port for a spark plug (not shown). A fan motor 22 is slidingly suspended within a depending cavity 24 in the center of the cylinder head 16 by a fan motor suspension system generally designated 26.

Figure 2:
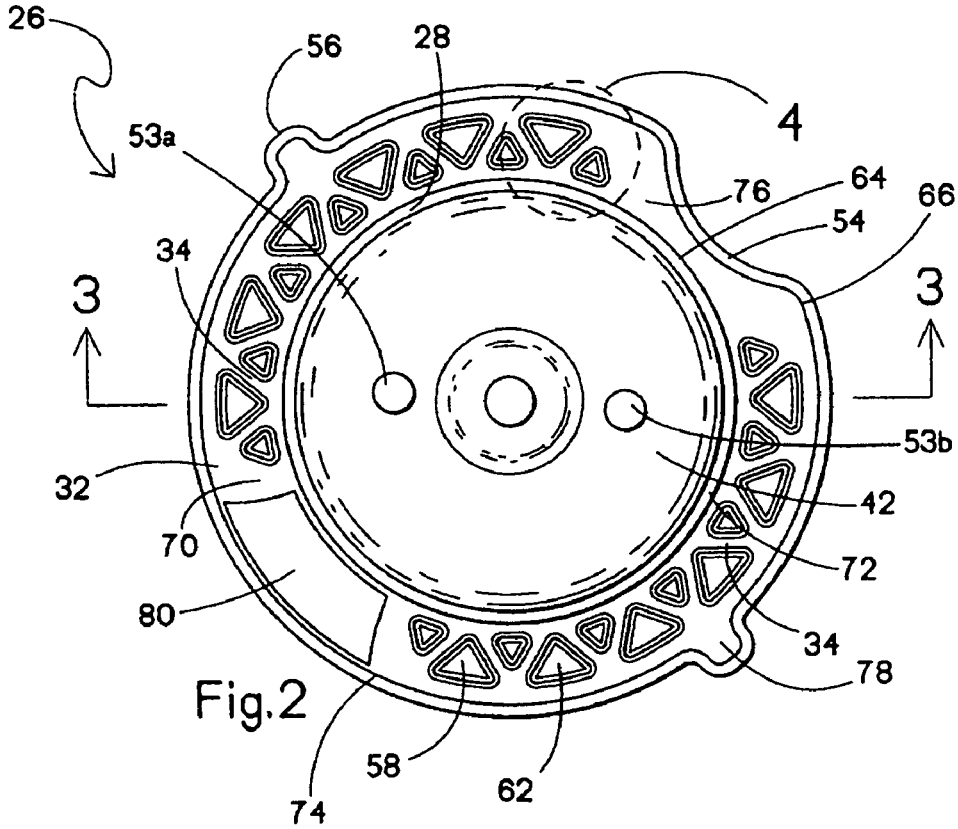
FIG. 2 is a top view of the present suspension system.
Figure 3:
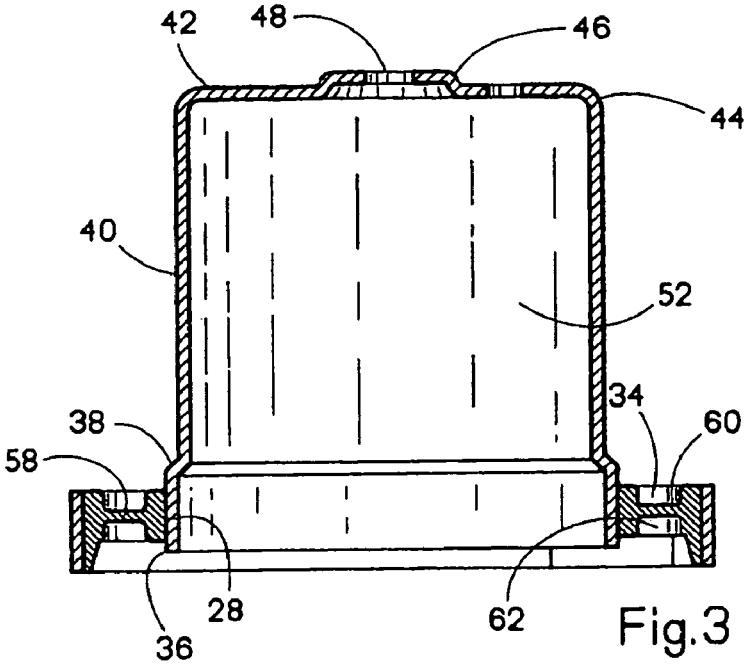
FIG. 3 is a cross-section of the present suspension system taken along the line 3—3 of FIG. 2 and in the direction generally indicated.

Referring now to FIGS. 2 and 3, the suspension system 26 includes a motor retaining ring 28 defining a space for accepting the motor 22, and an outer ring 30 radially spaced from the retaining ring. The outer ring 30 is configured for attachment to the cylinder head 16. At least one resilient suspension element 32 is configured for dampening vibrations and oscillations of the motor 22. Included in resilient suspension element 32 is a plurality of resilient beams 34 that are configured for connecting the retaining ring 28 and the outer ring 30.

The motor retaining ring 28 has a top edge 36 and a bottom edge 38. A generally cylindrical sidewall 40 depends from the bottom edge 38 of the retaining ring, and a generally circular base 42 is formed at a bottom edge 44 of the sidewall. A bottom of the base 42 is generally planar, but includes a circular lip 46 generally centrally located on the base. The lip 46 defines a through-hole 48 that is configured for receiving a drive shaft 50 (FIG. 1) of the motor 22.

A chamber 52 for the motor 22 is defined by sidewall 40 and base 42. The motor 22 slidably fits into the chamber 52 and is held in place by a pair of screws (not shown) that are configured to be inserted into openings 53*a* and 53*b*, located in base 42. The screws are then tightened into corresponding openings (not shown) in the motor 22. It is contemplated that the retaining ring 28 can have other shapes and components, depending on the size and shape of the combustion head chamber 20, as is known in the art. In combination, the retaining ring 28, the sidewall 40 and the base 42 form a cup-like motor retaining structure. While other types of fabrication are contemplated, it is preferred that the motor retaining structure be unitary. The motor retaining structure is preferably manufactured from a lightweight cost-effective metal alloy, such as steel, although it is appreciated that other materials may be used, as are known in the art. Also, the retaining ring 28 is generally manufactured by deep drawing, although it is appreciated that other means of manufacture are available.

As seen in FIG. 2, the outer ring 30 is radially spaced from the motor retaining ring 28 and includes an inwardly curved portion 54 that is configured for receiving a spark plug (not shown). The outer ring 30 also includes a pair of radially extending ears 56 located on opposite sides of the outer ring. In the present embodiment, the ears 56 are located directly opposite from each other and at an equal distance from the inwardly curved portion 54. However, it is contemplated that other arrangements for the ears 56 and the curved portion 54 are possible. The ears 56 are configured to be inserted into and removed from a pair of corresponding pockets or openings (not shown) in the cylinder head 16, thus orienting the suspension system 26 in the cylinder head. However, it is appreciated that other types of orientation are suitable, depending on the application.

The outer ring 30 is preferably manufactured from a lightweight, cost-effective metal alloy such as steel, and has an approximate thickness of 0.160". It is contemplated that the outer ring 30 is manufactured by stamping the steel. However, other manufacturing processes, materials and thicknesses are also contemplated to meet the needs of particular applications.

Referring still to FIG. 2, the plurality of resilient beams 34 are configured to connect the retaining ring 28 and the outer ring 30. In the present embodiment, at least one of the plurality of resilient beams 34 is rectangular in cross-section (best seen in FIG. 5), has a thickness of 0.102", and has a width of between 0.030" and 0.050." It is contemplated that the desired thickness and desired width of the beams 34 optimizes the effective resiliency of the suspension system 26 and decreases the acceleration forces experienced by the system during operation of the tool 10. It is further contemplated that the reduced acceleration forces will reduce the cost of the motor 22 in the tool 10, decreasing the overall cost of the tool.

Figure 5:
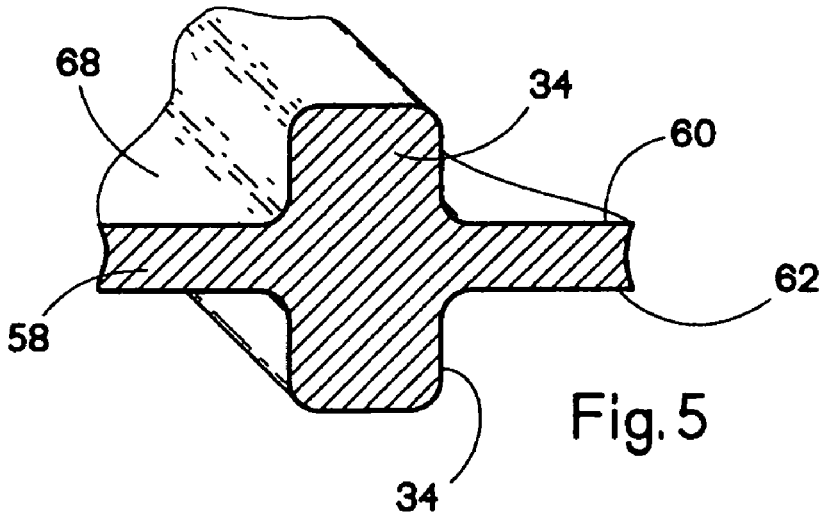
FIG. 5 is a cross-section of a beam member of the present suspension system taken along the line 5—5 of FIG. 4 and in the direction generally indicated.

Referring now to FIGS. 2, 3 and 5, the suspension element 32 further includes a flexible web 58 that is configured to separate the plurality of resilient beams 34 on an upper surface 60 of the web from the plurality of resilient beams on a lower surface 62 of the web. In the present embodiment, the beams 34 on the upper surface 60 of the web 58 are configured to be aligned with the beams on the lower surface 62 of the web. However, it is contemplated that the beams 34 on the upper surface 60 and the beams on the lower surface 62 can have alternate relative arrangements.

The flexible web 58 is preferably manufactured from Neoprene® rubber, as are the other components of the preferably unitary suspension element 32, and is molded to both an inner wall 64 and an outer wall 66 of the suspension element 32. It is contemplated that the rubber material will increase the resiliency of the suspension system 26 and decrease the effect of the acceleration forces acting on the motor 22 during operation. However, it is contemplated that other materials are available that would provide similar characteristics, as are known in the art.

Figure 4:
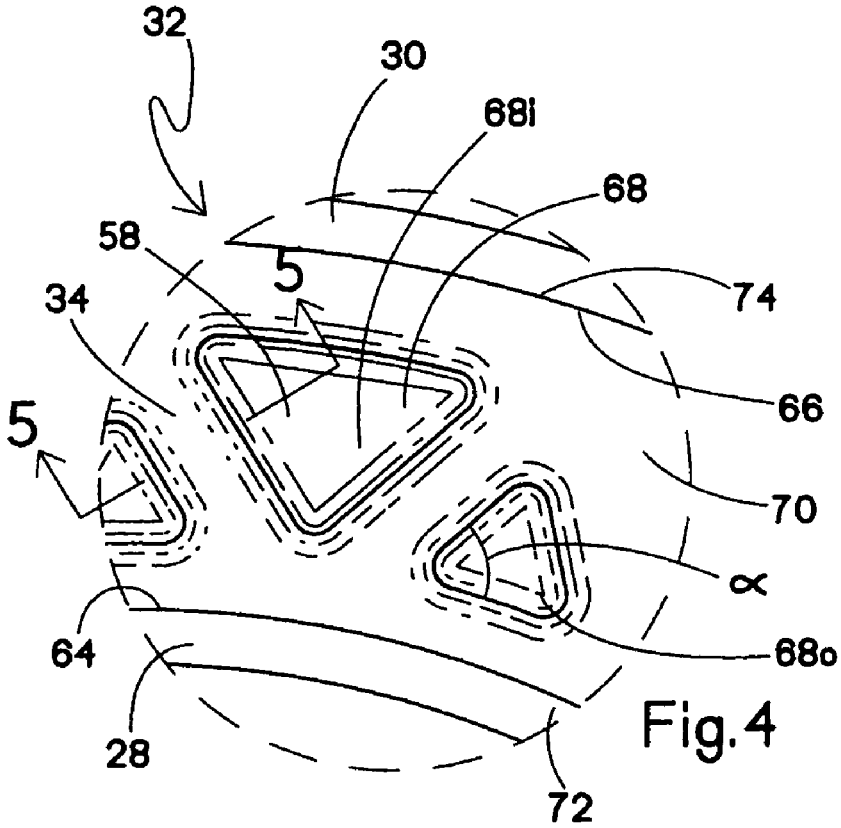
FIG. 4 is an enlarged fragmentary plan view of the present suspension system.

As seen in FIGS. 2 and 4, each of the plurality of beams 34 is arranged at either an acute or obtuse angle relative to a radius of the motor 22. In the present embodiment, the beams 34 are preferably arranged such that each of the beams forms an angle $\alpha$ of between 20–40° relative to the retaining ring 28. Also, pairs of adjacent beams 34 converge toward the retaining ring 28. It is contemplated that this arrangement optimizes the effective length of the beams 34, thus increasing the resiliency of the suspension element 32. When arranged in this manner, the beams 34 define a plurality of triangular recesses 68 located in a central annular groove portion 70 of the suspension element 32. The groove portion 70 is formed between the inner wall 64 and the outer wall 66 of the suspension element 32.

Referring now to FIGS. 2–4, the triangular recesses 68 are blind, in that they do not extend entirely through the groove portion 70. It is contemplated that the use of the blind recesses 68 prevents rubber flashings from forming during the manufacture of the suspension element 32 and falling into the tool 10 during operation. Although recesses 68 are formed in a triangular shape in the present embodiment, it is appreciated that other shapes of recesses may be formed depending on the arrangement of the rectangular beams 34. The recesses 68 in the present embodiment are preferably arranged in an offset pattern relative to each other. This offset pattern is a result of the arrangement of the rectangular beams 34 relative to the retaining ring 28. In the present embodiment, recesses 68*i* pointing towards the inner wall 64 of the suspension element 32 are larger than triangular recesses 68*o* pointing towards the outer wall 66 of the suspension element. However, it is appreciated that the triangular recesses 68 could be arranged in an opposite orientation and the suspension system 26 would achieve the same results.

The inner wall 64 of the suspension element 32 is configured to surround an outer edge 72 of the retaining ring 28, and is preferably attached to the outer edge of the retaining ring by means of vulcanization. However, other means of attachment are available, as are known in the art. The outer wall 66 of the suspension element 32 is configured to abut an inner edge 74 of the outer ring 30, and is also preferably attached to the inner edge of the outer ring by means of vulcanization. However, as indicated above, other means of attachment are available. The plurality of beams 34 connect the inner wall 64 to the outer wall 66, maintaining a connection between the retaining ring 28 and the outer ring 30. It is contemplated that manufacturing the suspension element 32 in unitary fashion out of Neoprene® rubber aids in increasing the resiliency of the system 26 and also decreases the acceleration forces that arise during operation of the tool 10.

Referring now to FIG. 2, the outer wall 66 of the suspension element 32 includes an inwardly curved portion 76 that is configured to correspond to the curved portion 54 of the outer ring 30 for receiving a spark plug (not shown). The outer wall 66 of the suspension element 32 further includes a pair of ears 78 that are configured to correspond with the ears 56 of the outer ring 30. The corresponding ears 56, 78, are preferably located directly opposite and in registry with each other and are configured to orient the system 26 to the cylinder head 16. It is contemplated that other means for orienting the suspension system 26 to the cylinder head 16 are available, as are known in the art, and the features of the present embodiment are not limited to the configuration described above.

Still referring to FIG. 2, the suspension element 32 further defines an opening 80 that is located diametrically opposite from the curved portion 76. The opening 80 interrupts the groove portion 70 of the suspension element 32, and therefore does not interrupt the continuity of the inner wall 64 or the outer wall 66 of the suspension element. It is contemplated that the opening 80 stabilizes the suspension system 26 because it offsets or balances the loss of suspension element material caused by the curved portion 76. More specifically, the curved portion 76 decreases the mass of the suspension element 32 on the curved portion end. As a result, it is contemplated that this arrangement stabilizes the system 26, preventing it from wobbling during operation of the tool 10.

It has been found that the present suspension system 26 accommodates the accelerations experienced by the motor 22 during operation of the tool 10. When the ignition of combustible gases in the chamber 20 forces a piston 82 and an associated driver blade 83 (FIG. 1) downwardly toward a workpiece (not shown), the tool 10 experiences a recoil force in the opposite direction. Both the motor 22, which is suspended by the suspension system 26 in the tool 10, and the drive shaft 50, are accelerated upwardly in the direction of the recoil of the tool by a force transmitted through the suspension system. Then, almost immediately thereafter, the piston 82 bottoms-out in a cylinder 84 against a bumper 86, reducing the acceleration of the tool 10 towards the workpiece. The motor 22 and the drive shaft 50 are now accelerated in this new, opposite direction. These reciprocal accelerations repeat, and as a result, the motor 22 oscillates within the tool 10. The present suspension system 26 accommodates and resiliently dampens these reciprocal accelerations, thus preventing the motor 22 from excessive oscillation.

An advantage of the present suspension system 26 is an increased resiliency or resistance to combustion-induced oscillations due to the arrangement and design of the plurality of beams 34 of the suspension element 32. The more resilient suspension system 26 is more flexible than prior art suspension systems, and provides properties for returning the motor 22 to its original operating position prior to the next use of the tool 10. It is also contemplated that this arrangement reduces the acceleration forces experienced by the motor 22 while the tool 10 is being operated, reducing the interior damage experienced by the motor. It is further contemplated that because of the decreased acceleration forces, a less expensive and more standard motor 22 can be utilized inside the tool 10, thereby increasing the cost-effectiveness of the tool.

While a particular embodiment of the present beam system membrane suspension for a motor mount has been described herein, it will be appreciated by those skilled in the art that changes and modifications may be made thereto without departing from the invention in its broader aspects and as set forth in the following claims.

The invention claimed is:

1. A suspension system for a motor of a combustion-powered hand tool having a cylinder head and a combustion chamber, comprising:

a motor retaining ring defining a space for accepting the motor;

an outer ring radially spaced from said retaining ring and configured for attachment to a cylinder head of a combustion chamber;

at least one resilient suspension element configured for dampening vibrations between a motor support and a tool frame, and having a plurality of resilient beams connecting the retaining ring and the outer ring, wherein at least one of said resilient beams is rectangular in cross-section, said plurality of resilient beams includes a plurality of upper resilient beams and a plurality of lower resilient beams; and a flexible web separating said plurality of upper resilient beams from said plurality of lower resilient beams.

2. The system of claim 1 wherein said plurality of beams are arranged at acute or obtuse angles relative to said retaining ring.

3. The system of claim 1 wherein said plurality of upper resilient beams are configured to be aligned with said plurality of lower resilient beams.

4. The system of claim 1 wherein said outer ring and said at least one resilient suspension element include mirrored inwardly curved portions configured for receiving a spark plug.

5. The system of claim 4 wherein said at least one resilient suspension element further includes an opening located opposite said inwardly curved portion and configured for stabilizing said system.

6. A suspension system for a motor of a combustion-powered hand tool having a cylinder head and a combustion chamber, comprising:

a motor retaining ring defining a space for accepting the motor;

an outer ring radially spaced from said retaining ring and configured for attachment to a cylinder head of a combustion chamber; and at least one resilient suspension element configured for dampening vibrations between a motor support and a tool frame, and having a plurality of resilient beams connecting the retaining ring and the outer ring, wherein at least one of said resilient beams is rectangular in cross-section; wherein said plurality of beams are arranged to define a plurality of triangular recesses.

7. The system of claim 6 wherein said plurality of triangular recesses are located in a groove portion of said at least one resilient suspension element formed between an inner wall and an outer wall of said at least one suspension element.

8. The system of claim 6 wherein said plurality of triangular recesses are arranged in an offset pattern relative to each other.

9. A suspension system for a motor of a combustion-powered hand tool having a cylinder head, comprising:

a flexible web disposed between said motor and said cylinder head and including at least one dampening structure configured for reducing a plurality of acceleration forces that result from operation of the tool;

said flexible web includes a plurality of beams configured for defining a plurality of recesses radially located thereon; and said beams are configured to form a border between each of said plurality of recesses.

10. The system of claim 9 wherein at least one of said plurality of beams forms an obtuse or an acute angle relative to said retaining ring.

11. The system of claim 9 wherein said plurality of beams are generally linearly extending on said flexible web.

12. The system of claim 9 wherein at least one of said plurality of beams is rectangular in cross-section.

13. The system of claim 12 where said plurality of generally rectangular beams is located on a topside of the web and said beams are aligned with a plurality of said generally rectangular beams on an underside of the web.

14. A suspension system for a motor of a combustion-powered hand tool having a cylinder head, comprising:

a flexible web disposed between said motor and said cylinder head and including at least one dampening structure configured for reducing a plurality of acceleration forces that result from operation of the tool;

said flexible web including a plurality of integrally formed linearly extending beams, said plurality of integrally formed linearly extending beams including upper and lower resilient beams; and said flexible web separating said plurality of integrally formed linearly extending beams into integrally formed said upper and said lower resilient beams.

15. The system of claim 14 wherein said plurality of beams are configured for defining a plurality of recesses radially located on said flexible web.

16. The system of claim 15 wherein said beams are configured to form a border between each of said plurality of recesses.

17. The system of claim 16 wherein said plurality of recesses are triangular in shape.

18. The system of claim 14 wherein at least one of said plurality of beams are rectangular in cross-section.

* * * * *

UNITED STATES PATENT AND TRADEMARK OFFICE

CERTIFICATE OF CORRECTION

PATENT NO. : 7,140,331 B1
APPLICATION NO. : 11/353462
DATED : November 28, 2006
INVENTOR(S) : William Heinzen It is certified that error appears in the above-identified patent and that said Letters Patent is hereby corrected as shown below:

On the cover, under Related U.S. Application Data, insert --[63] continuation of application no. 11/122,353 filed May 5, 2005.--.

Column 1, line 5, insert --This is a continuation of U.S. Serial no. 11/122,353 filed May 5, 2005 entitled BEAM SYSTEM MEMBRANE SUSPENSION FOR A MOTOR MOUNT.--.

Signed and Sealed this
Twenty-fourth Day of April, 2012

David J. Kappos

David J. Kappos
*Director of the United States Patent and Trademark Office*